US009668069B2

(12) United States Patent
Han et al.

(10) Patent No.: US 9,668,069 B2
(45) Date of Patent: May 30, 2017

(54) HEARING DEVICE AND EXTERNAL DEVICE BASED ON LIFE PATTERN

(71) Applicant: Samsung Electronics Co., Ltd., Suwon-si (KR)

(72) Inventors: Jooman Han, Seoul (KR); Dong Wook Kim, Seoul (KR); Jong Hee Han, Seoul (KR); See Youn Kwon, Seoul (KR); Sang Wook Kim, Seoul (KR); Jun Il Sohn, Yongin-si (KR); Jong Min Choi, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1 day.

(21) Appl. No.: 14/293,005

(22) Filed: Jun. 2, 2014

(65) Prior Publication Data

US 2015/0124984 A1 May 7, 2015

(30) Foreign Application Priority Data

Nov. 6, 2013 (KR) ..... 10-2013-0134123

(51) Int. Cl.
*H04R 25/00* (2006.01)

(52) U.S. Cl.
CPC ..... *H04R 25/43* (2013.01); *H04R 25/554* (2013.01); *H04R 2225/39* (2013.01); *H04R 2225/41* (2013.01); *H04R 2225/43* (2013.01)

(58) Field of Classification Search
CPC H04R 2225/41; H04R 2225/39; H04R 25/50; H04R 2225/55; H04R 25/305; H04R 2460/07; A61N 1/37235; H04M 1/7253
USPC ..... 381/312, 314, 323
See application file for complete search history.

(56) References Cited

U.S. PATENT DOCUMENTS

| | | | | |
|---|---|---|---|---|
| 2004/0264719 | A1 | 12/2004 | Naylor | |
| 2006/0182294 | A1 | 8/2006 | Grasbon et al. | |
| 2009/0147977 | A1 | 6/2009 | Lamm et al. | |
| 2010/0008515 | A1* | 1/2010 | Fulton | H04R 3/005 381/92 |
| 2010/0189293 | A1 | 7/2010 | Imamura et al. | |
| 2013/0070928 | A1* | 3/2013 | Ellis | H04R 25/30 381/56 |

FOREIGN PATENT DOCUMENTS

| | | |
|---|---|---|
| JP | 2011-10269 A | 1/2011 |
| JP | 2012-83746 A | 4/2012 |

OTHER PUBLICATIONS

International Search Report issued Sep. 29. 2014 in counterpart International Application No. PCT/KR2014/005679 (3 pages, in English).

* cited by examiner

*Primary Examiner* — George Monikang
(74) *Attorney, Agent, or Firm* — NSIP Law

(57) ABSTRACT

Disclosed is a hearing device that may classify sound environment based on a life pattern, and categorize sound information using a sound environment category set based on the life pattern, and control an output of the sound information based on the classified sound environment.

13 Claims, 9 Drawing Sheets

HEARING DEVICE AND EXTERNAL DEVICE BASED ON LIFE PATTERN

RELATED APPLICATIONS

This application claims the benefit under 35 USC 119(a) of Korean Patent Application No. 10-2013-0134123, filed on Nov. 6, 2013, in the Korean Intellectual Property Office, the entire disclosure of which is incorporated herein by reference for all purposes.

BACKGROUND

1. Field

The following description relates to a hearing device providing a sound and an external device interworking with the hearing device.

2. Description of Related Art

A hearing device may aid a user wearing the hearing device to hear sounds generated around the user. An example of a hearing device may be a hearing aid. The hearing aid may amplify sounds to aid those who have difficulty in perceiving sounds. In addition to a desired sound, other forms of sounds may also be input to the hearing device. There is a desire for technology to control the hearing aid to provide its wearer with a desired sound among those input to the hearing device.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, there is provided a hearing device including an input unit configured to receive sound information, a classifier configured to classify the sound information into a category using a sound environment category set based on a life pattern, and a controller configured to control an output of the sound information based on the classified category.

The sound environment category set may correspond to a pattern element of the life pattern based on environment information.

The classifier may be further configured to classify the sound information based on extracting a sound feature from the sound information and comparing the sound feature to sound feature maps corresponding to sound environment categories of the sound environment category set.

The classifier may be further configured to select, based on the sound information, a sound environment category from the sound environment categories of the sound environment category set, and the controller may be further configured to control the output of the sound information using a setting corresponding to the selected sound environment category.

The controller may be further configured to adjust output gain of frequency components in the sound information based on the category of the sound information.

The life pattern comprises pattern elements may correspond to different sound environment category sets.

The hearing device may include a communicator configured to receive the sound environment category set from a device connected to the hearing device.

The sound environment category set may be selected based on environment information sensed by the device and comprises sound environment categories corresponding to sound feature maps.

The communicator may be further configured to transmit, to the device, a sound feature extracted from the sound information to update the sound environment category set.

The environment information may include at least one of time information, location information, or speed information.

In another general aspect, there is provided a device interworking with a hearing device, the device including a store configured to store sound environment category sets based on a life pattern, a sensor configured to sense environment information, a selector configured to select a pattern element based on the environment information, and a communicator configured to transmit, to the hearing device, a sound environment category set corresponding to the selected pattern element.

The life pattern may include the pattern elements corresponding to different sound environment category sets.

The sound environment category set may include sound environment categories corresponding to sound feature maps.

The device may include an updater configured to update the sound environment category set based on a sound feature received from the hearing device, and wherein the sound feature is extracted from sound information by the hearing device.

The sensor may be configured to sense at least one of time information, location information, or speed information.

In another general aspect, there is provided a device to generate life pattern for a hearing device, the device including a user input configured to receive an input, an environmental feature extractor configured to extract environmental feature from environment information, and a generator configured to generate life pattern elements based on at least one of the input, the extract environmental feature, or the sound feature, wherein life pattern comprises a plurality of life pattern elements.

A sound feature extractor may be configured to receive a sound feature extracted by the hearing device, wherein the generator is further configured to generate sound environment category set based on the extracted sound feature and the life pattern elements.

The device may include a communicator configured to transmit, to the hearing device, a sound environment category set corresponding to a selected pattern element.

The device to generate life pattern may be disposed in the hearing device.

The device to generate life pattern may be disposed in a second device that is connected to a hearing device.

Other features and aspects will be apparent from the following detailed description, the drawings, and the claims.

Figure 1:
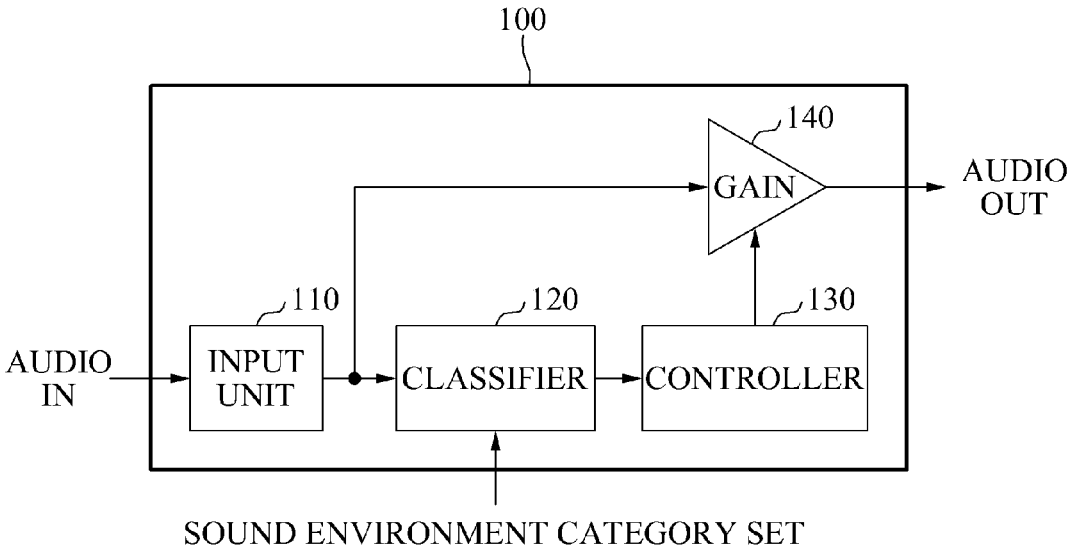
FIG. 1 is a diagram illustrating an example of a hearing device.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

FIG. 1 is a diagram illustrating an example of a hearing device 100. A hearing device refers to a device that aids a user in hearing and may include, for example, a hearing aid. The hearing device may include all devices that are detachably fixed to or in close contact with an ear of a user to provide the user with audio signals based on a sound generated outside the ear of the user. The hearing device may include a hearing aid that amplifies an audio signal generated from an external source and aids the user in perceiving the audio signal. The hearing device may include or be included in a system supporting a hearing aid function. Such a system may include, but is not limited to, a mobile device, a cellular phone, a smart phone, a wearable smart device (such as, for example, a ring, a watch, a pair of glasses, a bracelet, an ankle bracket, a belt, a necklace, an earring, a headband, a helmet, a device embedded in the cloths or the like), a personal computer (PC), a tablet personal computer (tablet), a phablet, a personal digital assistant (PDA), a digital camera, a portable game console, an MP3 player, a portable/personal multimedia player (PMP), a handheld e-book, an ultra mobile personal computer (UMPC), a portable lab-top PC, a global positioning system (GPS) navigation, and devices such as a television (TV), a high definition television (HDTV), an optical disc player, a DVD player, a Blue-ray player, a setup box, any other, consumer electronics/information technology (CE/IT) device, a plug-in accessory or a hearing aid module having a sound or broadcasting relay function for a hearing aid, and a hearing aid chip.

Referring to FIG. 1, the hearing device may include an input unit 110, a classifier 120, a controller 130, and a output gain adjuster 140. The input unit 110 may receive sound information. Here, the sound information may include, but is not limited to, a human voice, musical sounds, ambient noise, and the like. The input unit 110 may be a module for receiving an input of the sound information and may include, for example, a microphone.

The classifier 120 may classify the sound information into a category. A sound information category may be a standard for classifying the sound information. The sound information may be classified into categories, such as, for example, speech music, noise, or noise plus speech. The speech category may be a category of sound information corresponding to the human voice. The music category, the noise category, and the noise plus speech category may be categories of sound information corresponding to the musical sounds, the ambient noise, and the human voice amid the ambient noise, respectively. The foregoing categories are only non-exhaustive illustrations of categories of sound information, and other categories of sound information are considered to be well within the scope of the present disclosure.

The classifier 120 may classify the sound information categories using a sound environment category set. The sound environment category set may be composed of a plurality of categories based on a sound environment. The sound environment may be an environment under which the sound information is input. For example, the sound environment may refer to a very quiet environment such as a library, a relatively quiet environment such as a home, a relatively noisy environment such as a street, and a very noisy environment such as a concert hall. The sound environment may refer to an in-vehicle environment where engine noise exists or an environment having a sound of running water such as a stream flowing in a valley. As shown in the foregoing examples, the sound environment may be defined based on various factors.

The sound environment category set may include the different categories into which the sound information input from a sound environment is classified. In an example, a first sound environment category set may include categories into which sound information input from the very quiet environment, such as, a library is classified. The first sound environment category set may include the speech category, the music category, the noise category, and the noise plus speech category. The classifier 120 may classify the sound information input from the very quiet environment into one of the speech category, the music category, the noise category, and the noise plus speech category, using the first sound environment category set. When a person converses with another person in the very quiet environment, the classifier 120 may classify the sound information into the speech category of the first sound environment category set. When a person listens to music in the very quiet environment, the classifier 120 may classify the sound information into the music category of the first sound environment category set. When the ambient noise, for example, noise occurring by pulling a chair, occurs in the very quiet environment, the classifier 120 may classify the sound information into the noise category of the first sound environment category set. When a person converses with another person while pulling a chair in the very quiet environment, the classifier 120 may classify the sound information into the noise plus speech category of the first sound environment category set.

In another example, a second sound environment category set may include categories into which sound information input from the relatively noisy environment, such as, a street is classified. The second sound environment category set may include the speech category, the music category, the noise category, and the noise plus speech category. The classifier 120 may classify the sound information input from the relatively noisy environment into one of the speech category, the music category, the noise category, and the noise plus speech category, using the second sound environment category set. The relatively noisy environment may not refer to an environment where ambient noise always occurs, but can be understood as an environment where ambient noise is highly probable. For example, a construction site may be an example of the relatively noisy environment, but the ambient noise may not occur when machine that generates noise remains idle for a short period of time. When one person converses with another in the relatively noisy environment while the ambient noise does not occur for a short period of time, the classifier 120 may classify the sound information into the speech category of the second sound environment category set. When a person listens to music in the relatively noisy environment, the classifier 120 may classify the sound information into the music category of the second sound environment category set. When the ambient noise occurs in the relatively noisy environment, the classifier 120 may classify the sound information into the noise category of the second sound environment category set. When one person converses with another amid the ambient noise in the relatively noisy environment, the classifier 120 may classify the sound information into the noise plus speech category of the second sound environment category set.

In another example, a third sound environment category set may include categories into which sound information input from in-vehicle environment where engine noise is present. The third sound environment category set may include the speech category, the music category, the noise category, and the noise plus speech category. The classifier 120 may classify the sound information input from the in-vehicle environment into one of the speech category, the music category, the noise category, and the noise plus speech category, using the third sound environment category set. When one person converses with another person in the in-vehicle environment, the classifier 120 may classify the sound information into the speech category of the third sound environment category set. When a person listens to music in the in-vehicle environment, the classifier 120 may classify the sound information into the music category of the third sound environment category set. When the ambient noise only includes the engine noise, without the human voice or the music sound being present, in the in-vehicle environment, the classifier 120 may classify the sound information into the noise category of the third sound environment category set. When the human voice is heard in the in-vehicle environment along with the ambient noise, the classifier 120 may classify the sound information into the noise plus speech category of the third sound environment category set.

The categories included in the sound environment category sets may correspond to sound feature maps. The classifier 120 may classify the sound information based on the sound feature maps. A description of the sound environment category sets will be provided with reference to FIG. 2.

The classifier 120 may use the sound environment category sets based on the life pattern to classify the sound information. The classifier 120 may use a sound environment category set selected from among the sound environment category sets based on the life pattern. The sound environment may vary based on the life pattern. For example, when a user of the hearing device 100 spends time at home in the morning, after waking up and before going to work, the classifier 120 may use a sound environment category set corresponding to a sound environment at home. In this case, the classifier 120 may classify the sound information into one of the speech category, the music category, the noise category, and the noise plus speech category included in the sound environment category set corresponding to the sound environment at home. In another example, when the user is at work during business hours, the classifier 120 may use a sound environment category set corresponding to a sound environment at work. In this case, the classifier 120 may classify the sound information into one of the speech category, the music category, the noise category, and the noise plus speech category included in the sound environment category set corresponding to the sound environment at work. In another example, when the user is commuting to or from work, the classifier 120 may use a sound environment category set corresponding to an in-subway train or an in-vehicle sound environment. In this case, the classifier 120 may classify the sound information into one of the speech category, the music category, the noise category, and the noise plus speech category included in the sound environment category set corresponding to the in-subway train or the in-vehicle sound environment.

Because a correlation exists between a change of the sound environment in a daily life and a life pattern, the hearing device may provide technology for improving accuracy in classifying the sound information.

The controller 130 may control the output of the sound information based on the sound information category. The controller 130 may control the output of the sound information based on a setting corresponding to the classified sound information category. In an example, when the sound information is classified into the speech category of the sound environment category set corresponding to the in-vehicle environment where engine noise is present, the controller 130 may control the output of the sound information using a setting for attenuating the engine noise and amplifying the human voice. When the sound information is classified as the music category of the sound environment category set corresponding to the in-vehicle sound environment where engine noise is present, the controller 130 may control the output of the sound information using a setting for attenuating the engine noise and amplifying the music sound. When the sound information is classified into the noise category of the sound environment category set corresponding to the in-vehicle sound environment where engine noise is present, the controller 130 may control the output of the sound information using a setting for attenuating the engine noise. When the sound information is classified into the noise plus speech category of the sound environment category set corresponding to the in-vehicle environment in which the engine noise is present, the controller 130 may control the output of the sound information using a setting for attenuating the engine noise and amplifying the human voice.

In another example, when the sound information is classified into the speech category of the sound environment category set corresponding to the very quiet environment such as a library, the controller 130 may control the output of the sound information using a setting for amplifying the human voice without considering the ambient noise. When the sound information is classified into the music category of the sound environment category set corresponding to the very quiet environment, the controller 130 may control the output of the sound information using the setting for amplifying the music sound without considering the ambient noise. When the sound information is classified into the noise category of the sound environment category set corresponding to the very quiet environment, the controller 130 may control the output of the sound information using the setting for attenuating the ambient noise. When the sound information is classified into the noise plus speech category of the sound environment category set corresponding to the very quiet environment, the controller 130 may control the output of the sound information using the setting for attenuating the ambient noise and amplifying the human voice.

The hearing device 100 may further include an output gain adjuster 140. The output gain adjuster 140 may adjust an output gain of the sound information input by the input unit 110. The output gain adjuster 140 may amplify or attenuate the sound information. The sound information may include various frequency components, and the output gain adjuster 140 may control output gain of each frequency components included in the sound information. For example, the output gain adjuster 140 may amplify a second frequency component in the sound information while attenuating a first frequency component in the sound information.

The output gain adjuster 140 may be controlled by the controller 130 to adjust the output gain of the sound information. The controller 130 may control the output gain adjuster 140 based on the sound information category. The controller 130 may control the output gain adjuster 140 based on a setting corresponding to the sound information category. For example, when the sound information is classified into the music category of the sound environment category set corresponding to the in-vehicle sound environment, the controller 130 may attenuate a frequency component corresponding to the engine noise, among the frequency components included in the sound information, and may amplify a frequency component corresponding to the music sound, among the frequency components included in the sound information.

Figure 2:
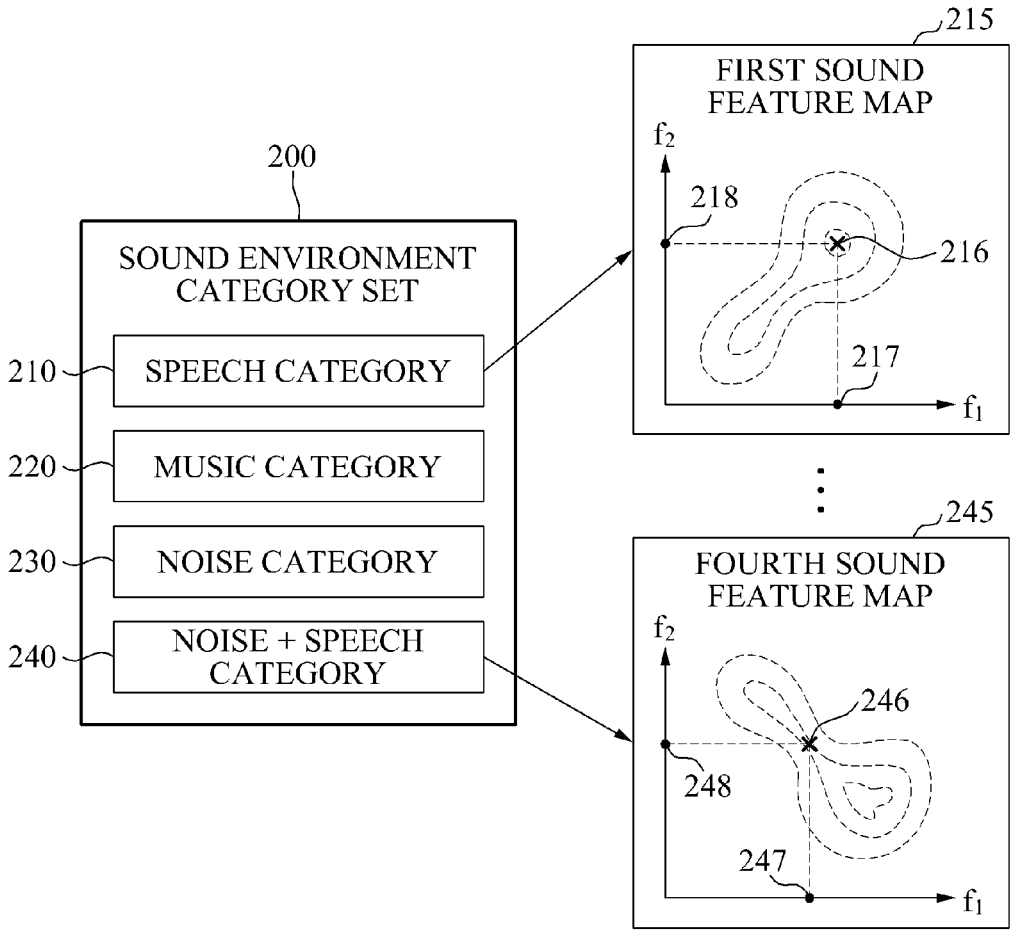
FIG. 2 is a diagram illustrating an example of a sound environment category set.

FIG. 2 is a diagram illustrating an example of a sound environment category set 200. Referring to FIG. 2, the sound environment category set 200 may include a speech category 210, a music category 220, a noise category 230, and a noise plus speech category 240. As illustrated in FIG. 1, the sound environment category set 200 may include sound environment categories into which sound information is classified in a sound environment. FIG. 2 illustrates examples of the sound environment categories including the speech category 210, the music category 220, the noise category 230, and the noise plus speech category 240.

The sound environment categories of the sound environment category set 200 may correspond to sound feature maps. For example, the speech category 210 may correspond to a first sound feature map 215, the music category 220 may correspond to a second sound feature map (not shown), the noise category 230 may correspond to a third sound feature map (not shown), the noise plus speech category 240 may correspond to a fourth sound feature map 245. The sound feature maps may refer to data indicating features of the sound environment categories based on the sound features.

The sound features may refer to features of the sound information, such as, for example, a mel-frequency cepstrum coefficient (MFCC), relative-band power, spectral roll-off, spectral centroid, and zero-cross rate. The MFCC is a coefficient indicating a short-term power spectrum of a sound, may be a sound feature used for applications such as automatic recognition of a number of voice syllables, voice identification, and similar music retrieval. The relative-band power may be a sound feature indicating a relative power magnitude of a sound in comparison to an overall sound power. The spectral roll-off may be a sound feature indicating a roll-off frequency at which an area below a curve of a sound spectrum reaches a critical area. The spectral centroid may be a sound feature indicating a centroid of the area below the curve of the sound spectrum. The zero-crossing rate may be a sound feature indicating a speed at which a sound converges on "0."

For example, when the sound environment category set 200 corresponds to a sound environment of a park, the speech category 210 may be a standard for distinguishing a human voice in the sound environment of the park. The first sound feature map 215 corresponding to the speech category 210 may be reference data indicating sound features of the human voice input from the sound environment of the park. For example, when an MFCC distribution and a spectral roll-off distribution of the human voice input from the sound environment of the park are predetermined, a two-dimensional sound feature map may be generated in advance to distinguish the human voice input from the sound environment of the park. In this case, an "x" axis of the first sound feature map 215 may indicate a first sound feature, for example, "$f_1$" corresponding to the MFCC, and a "y" axis of the first sound feature map 215 may indicate a second sound feature, for example, "$f_2$," corresponding to the spectral roll-off.

The first sound feature map 215 may be represented in a form of a contour line based on a degree of density in sound feature distribution. For example, a height of the contour line may be drawn to be high relative to a position at which the sound feature distribution is dense. Conversely, the height of the contour line may be drawn to be low relative to a position at which the sound feature distribution is dispersed. The classifier 120 of FIG. 1 may extract the MFCC and the spectral roll-off from the sound information to be input, and obtain the height of the contour line at a position indicated by the MFCC and the spectral roll-off extracted based on the first sound feature map 215.

The fourth sound feature map 245 corresponding to the noise plus speech category 240 may be reference data indicating the sound features of the human voice input during the ambient noise occurring in the sound environment of the park. For example, when the MFCC distribution and the spectral roll-off distribution of the human voice input during the ambient noise occurring in the sound environment of the park are predetermined, a two-dimensional sound feature map may be generated in advance to distinguish the human voice input during an occurrence of the ambient noise in the sound environment of the park. In this case, the "x" axis of the fourth sound feature map 245 may indicate a first sound feature, for example, "$f_1$," corresponding to the MFCC, and the "y" axis of the fourth sound feature map 245 may indicate a second sound feature, for example, "$f_2$," corresponding to the spectral roll-off.

As shown in the first sound feature map 215, the fourth sound feature map 245 may be represented in a form of a contour line based on a degree of density in sound feature distribution. The classifier 120 of FIG. 1 may extract the MFCC and the spectral roll-off from the sound information to be input, and obtain the height of the contour line at a position indicated by the MFCC and the spectral roll-off extracted based on the fourth sound feature map 245.

The classifier 120 may compare the height of the contour line obtained from the first sound feature map 215 to the height of the contour line obtained from the fourth sound feature map 245. As a result of the comparing performed by the classifier 120, the classifier 120 may select, from the maps, a sound feature map outputting a height surpassing that of the contour line. The classifier 120 may select a sound environment category corresponding to the selected sound feature map. For example, when the first sound feature, $f_1$, of the sound information to be input indicates 217 and 247 on the "x" axes and the second sound feature, $f_2$, of the sound information to be input indicates 218 and 248 on the "y" axes, the sound information to be input may indicate a position 216 on the first sound feature map 215 and a position 246 on the fourth sound feature map 245. In this case, the height of the position 216 is higher than the height of the position 246 and thus, the classifier 120 may select the speech category 210.

For convenience of description, an example in which the two sound feature maps use two sound features is described. However, a sound feature map using three or more sound features is considered to be well within the scope of the present disclosure. When the three or more sound features are used, a three-dimensional, or higher, sound feature map may be generated. Based on the three-dimensional map, or one of higher dimensions, a height equivalent to the height of the contour line obtained from the two-dimensional sound feature maps may be calculated. More particularly, a height at a position on the three-dimensional map in which distribution of three or more sound features is denser may be calculated to be higher. A height at a position in which the distribution of three or more sound features is dispersed on the three-dimensional map may be calculated to be lower.

Figure 3:
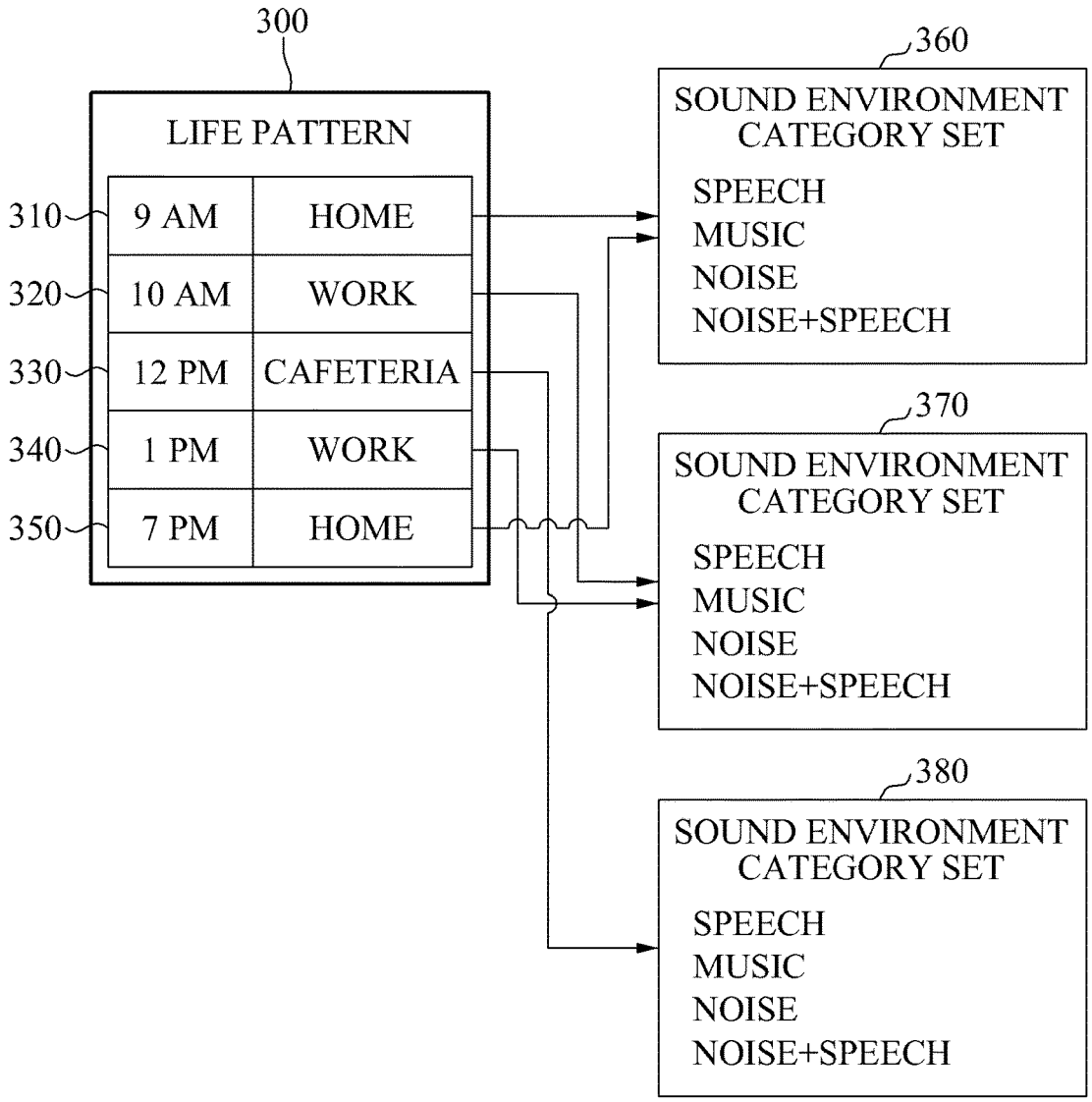
FIG. 3 is a diagram illustrating an example of a life pattern.

FIG. 3 is a diagram illustrating an example of a life pattern 300. Referring to FIG. 3, the life pattern 300 may include pattern elements, for example, 310, 320, 330, 340, and 350, which are classified based on time. A pattern element 310 may correspond to a pattern at 9:00 a.m., a pattern element 320 may correspond to a pattern at 10:00 a.m., a pattern element 330 may correspond to a pattern at 12:00 p.m., a pattern element 340 may correspond to a pattern at 1:00 p.m., and a pattern element 350 may correspond to a pattern at 7:00 p.m. The foregoing pattern elements may be classified based on times at which corresponding patterns begin. However, the pattern elements may vary, for example, by being classified based on a time slot.

The pattern elements, for example, 310, 320, 330, 340, and 350, of the life pattern 300 may correspond to sound environment category sets, for example, 360, 370, and 380. For example, the pattern element 310 may correspond to a sound environment category set 360, which corresponds to a sound environment at home. The pattern element 320 may correspond to a sound environment category set 370, which corresponds to a sound environment at work. The pattern element 330 may correspond to a sound environment category set 380, which corresponds to a sound environment of a cafeteria.

Although a sound environment category set used to classify sound information by a hearing device may be determined based on the life pattern 300, it is to be understood that the life pattern 300 is only provided as an example and the present disclosure is not limited thereto. In addition, detailed descriptions of alternative exemplary life patterns is provided with reference with FIGS. 6 and 7. For example, one of the pattern elements may be selected from the pattern elements of the life pattern 300 based on environment information, and a sound environment category set used to classify the sound information by the hearing device may be determined as a sound environment category set corresponding to the selected pattern element. The environment information may include information on environment surrounding a user of the hearing device, which may include, for example, time, a location, and a moving speed. For example, when the time included in the environment information indicates 9:00 a.m., the classifier 120 of FIG. 1 may classify the sound information using the sound environment category set 360 corresponding to the pattern element 310. For another example, when the time included in the environment information indicates 12:00 p.m., the classifier 120 may classify the sound information using the sound environment category set 380 corresponding to the pattern element 330.

Figure 4:
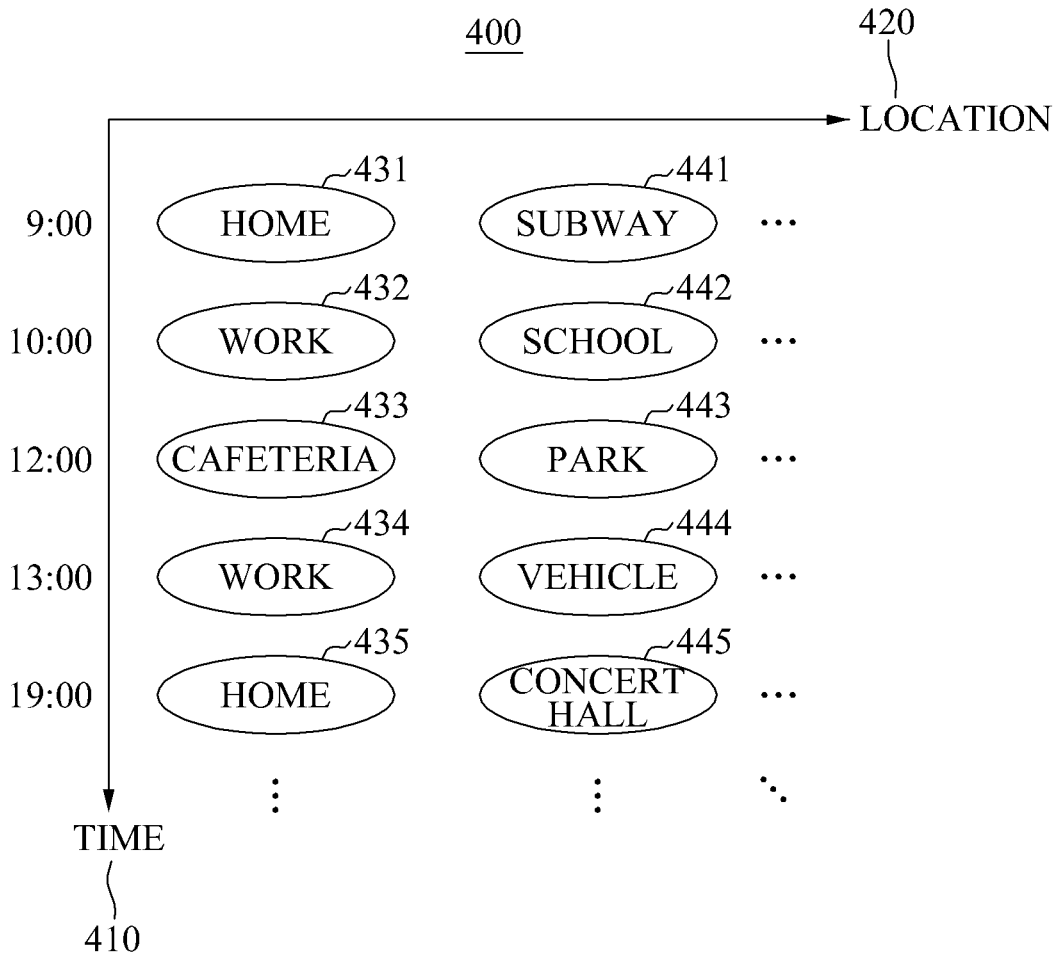
FIG. 4 is a diagram illustrating another example of a life pattern.

FIG. 4 is a diagram illustrating an example of a life pattern 400. Referring to FIG. 4, the life pattern 400 may include pattern elements, for example, 431, 432, 433, 434, 435, 441, 442, 443, 444, and 445, which are classified based on a time 410 and a location 420. A pattern element 431 may be a pattern corresponding to 9:00 a.m. at home, a pattern element 432 may be a pattern corresponding to 10:00 a.m. at work, a pattern element 433 may be a pattern corresponding to 12:00 p.m. at a cafeteria, a pattern element 434 may be a pattern corresponding to 1:00 p.m. at work, and a pattern element 435 may be a pattern corresponding to 7:00 p.m. at home. A pattern element 441 may be a pattern corresponding to 9:00 a.m. in a subway train, a pattern element 442 may be a pattern corresponding to 10:00 a.m. in a school, a pattern element 443 may be a pattern corresponding to 12:00 p.m. at a park, a pattern element 444 may be a pattern corresponding to 1:00 p.m. in a vehicle, and a pattern element 445 may be a pattern corresponding to 7:00 p.m. in a concert hall.

The pattern elements, for example, 431, 432, 433, 434, 435, 441, 442, 443, 444, and 445, of the life pattern 400 may correspond to sound environment category sets (not shown). For example, the pattern element 431 and the pattern element 435 may correspond to the sound environment category sets corresponding to a sound environment at home. The pattern element 432 and the pattern element 434 may correspond to the sound environment category sets corresponding to a sound environment at work. The pattern element 433 may correspond to the sound environment category set corresponding to a sound environment of a cafeteria. The pattern element 441 may correspond to the sound environment category set corresponding to a sound environment of a subway train. The pattern element 442 may correspond to the sound environment category set corresponding to a sound environment of a school. The pattern element 443 may correspond to the sound environment category set corresponding to a sound environment of a park. The pattern element 444 may correspond to the sound environment category set corresponding to a sound environment of a vehicle. The pattern element 445 may correspond to the sound environment category set corresponding to a sound environment of a concert hall.

Although a sound environment category set used to classify sound information by a hearing device may be determined based on the life pattern 400, it is to be understood that the life pattern 400 is only provided as an example and the present disclosure is not limited thereto. Descriptions of some alternative exemplary life patterns is provided with reference with FIGS. 6 and 7. One of the pattern elements may be selected from the pattern elements, for example, 431, 432, 433, 434, 435, 441, 442, 443, 444, and 445, of the life pattern 400 based on environment information, and a sound environment category set used to classify the sound information by the hearing device may be determined as a sound environment category set corresponding to the selected pattern element. Unlike the life pattern 300 of FIG. 3, a location 420 included in the environment information, along with a time 410, may be used for the selection.

For example, when the time 410 included in the environment information indicates 9 a.m. and the location 420 included in the environment information indicates home, the classifier 120 of FIG. 1 may classify sound information using a sound environment category set corresponding to the pattern element 431. When the time 410 in the environment information indicates 9:00 a.m. and the location 420 in the environment information indicates a subway train, the classifier 120 may classify sound information using a sound environment category set corresponding to the pattern element 441. When the time 410 in the environment information indicates 12:00 p.m. and the location 420 in the environment information indicates a cafeteria, the classifier 120 may classify sound information using a sound environment category set corresponding to the pattern element 433. When the time 410 in the environment information indicates 12:00 p.m. and the location 420 in the environment information indicates a park, the classifier 120 may classify sound information using a sound environment category set corresponding to the pattern element 443.

The location 420 in the environment information may not directly indicate a home, a workplace, a cafeteria, and the like. For example, the location 420 in the environment information may position of the subject that is ascertained by global positioning system (GPS) coordinates. The GPS coordinates included in the environment information may indirectly indicate whether the subject is located at a home, a workplace, a cafeteria, and the like based on, for example, map data. In another example, the "x" axis of the life pattern 400 may be indicated by a moving speed in lieu of the location 420. For example, the pattern element 441 indicated as the pattern corresponding to 9:00 a.m. in a subway train may be indicated as a pattern corresponding to 9:00 a.m. at 35 kilometers per hour (km/h) and thus, be distinguished from other pattern elements. Here, when the time 410 in the environment information indicates 9:00 a.m. and the moving speed in the environment information indicates 35 km/h, the classifier 120 of FIG. 1 may classify sound information using a sound environment category set corresponding to the pattern element 441.

Figure 5:
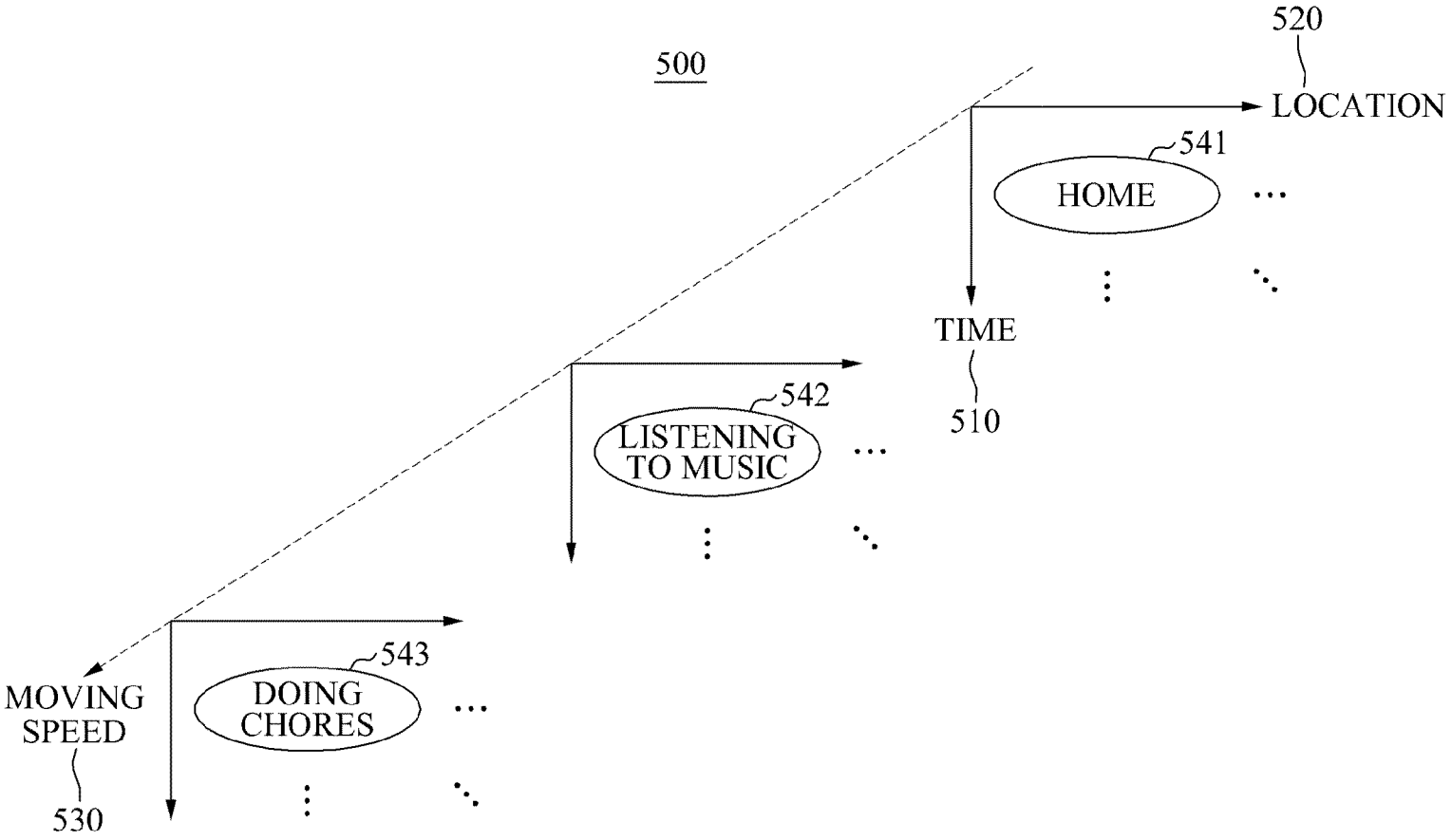
FIG. 5 is a diagram illustrating another example of a life pattern.

FIG. 5 is a diagram illustrating another example of a life pattern 500. Referring to FIG. 5, the life pattern 500 may include pattern elements, for example, 542 and 543, which are classified based on a location 520 and a moving speed 530. More particularly, a pattern element 541 may correspond to the pattern element 431 of FIG. 4. The pattern element 541 may be sub-classified into a pattern element 542 and a pattern element 543 based on the moving speed 530. For example, a user of a hearing device may have both patterns including a first life pattern of listening to music, at home, at 9:00 a.m., and a second life pattern of doing household chores at 9:00 a.m.

In this case, the pattern element 542 may be a pattern corresponding to 9:00 a.m. at home without movement, and the pattern element 543 may be a pattern corresponding to 9:00 a.m. at home with movement. The pattern element 542 may correspond to a sound environment category set corresponding to a sound environment in which a musical sound is heard at home. The pattern element 543 may correspond to a sound environment category set corresponding to a sound environment in which vacuum cleaner noise is present in a home.

Although a sound environment category set used to classify sound information by a hearing device may be determined based on the life pattern 500, it is to be understood that the life pattern 500 is only provided as an example and the present disclosure is not limited thereto. Descriptions of alternate exemplary life patterns are provided with reference with FIGS. 6 and 7. A pattern element may be selected from the pattern elements of the life pattern 500 based on environment information, and the sound environment category set may be determined as the sound environment category set corresponding to the selected pattern element. For example, the moving speed 530, along with the time 510 and the location 520, in the environment information may be used to determine a pattern element. When the time 510 in the environment information indicates 9:00 a.m., the location 520 in the environment information indicates a home, and the moving speed 530 in the environment information indicates a value close to "0," the classifier 120 of FIG. 1 may classify sound information using a sound environment category set corresponding to the pattern element 542.

Figure 6:
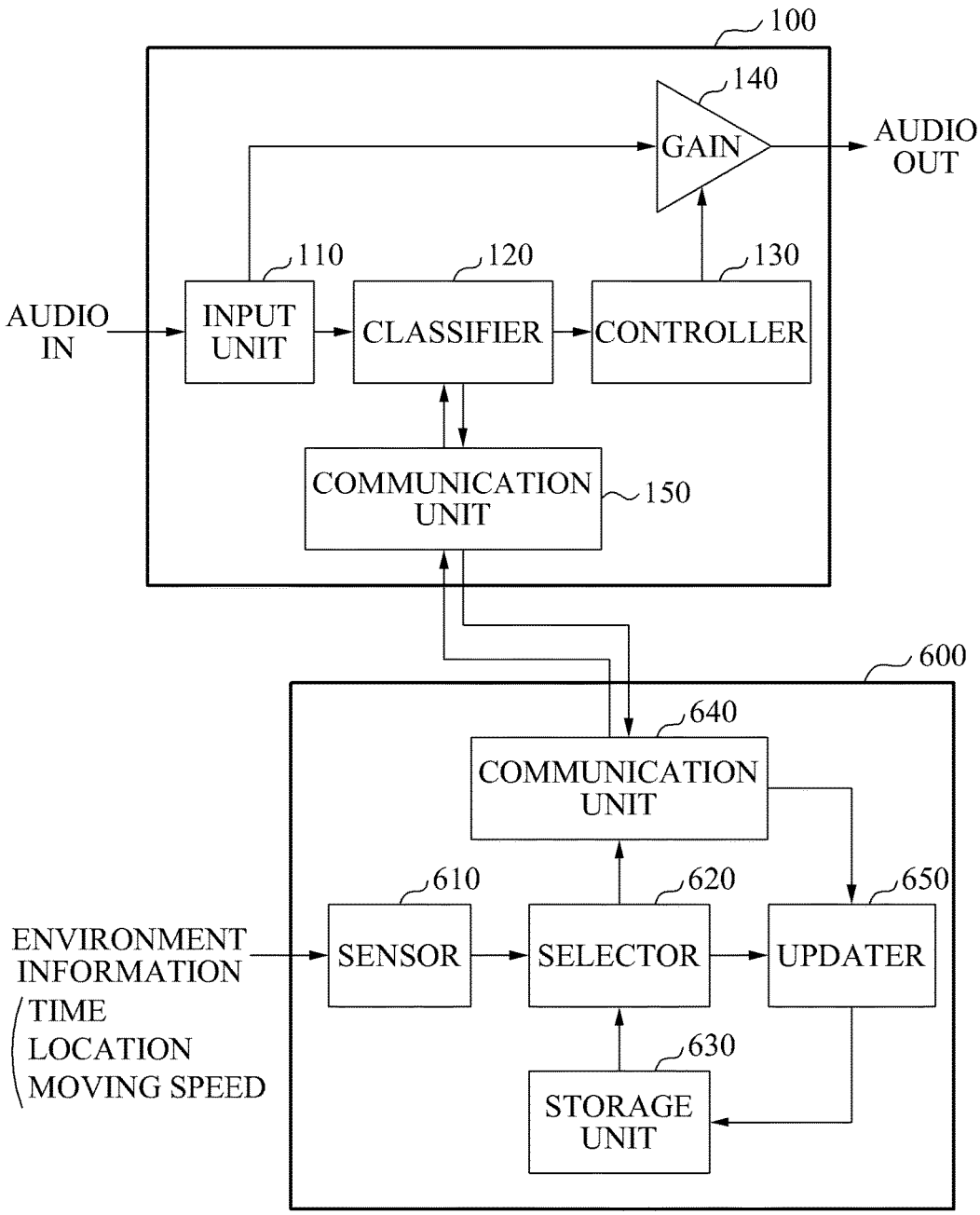
FIG. 6 is a diagram illustrating an example of an external device interworking with a hearing device.

FIG. 6 is a diagram illustrating an example of an external device 600 interworking with a hearing device 100. The external device 600 may refer to a device provided separately from the hearing device 100. The external device 600 may be provided in various forms. For example, as a non-exhaustive illustration only, the external device 600 may refer to mobile devices such as, for example, a cellular phone, a smart phone, a wearable smart device (such as, for example, a ring, a watch, a pair of glasses, a bracelet, an ankle bracket, a belt, a necklace, an earring, a headband, a helmet, a device embedded in the cloths or the like), a personal computer (PC), a tablet personal computer (tablet), a phablet, a mobile internet device (MID), a personal digital assistant (PDA), an enterprise digital assistant (EDA), a digital camera, a digital video camera, a portable game console, an MP3 player, a portable/personal multimedia player (PMP), a handheld e-book, an ultra mobile personal computer (UMPC), a portable lab-top PC, a global positioning system (GPS) navigation, a personal navigation device or portable navigation device (PND), a handheld game console, an e-book, and devices such as a high definition television (HDTV), an optical disc player, a DVD player, a Blue-ray player, a setup box, or any other device capable of wireless communication or network communication consistent with that disclosed herein. The wearable device may be self-mountable on the body of the user, such as, for example, the glasses or the bracelet. In another non-exhaustive example, the wearable device may be mounted on the body of the user through an attaching device, such as, for example, attaching a smart phone or a tablet to the arm of a user using an armband, or hanging the wearable device around the neck of a user using a lanyard. Referring to FIG. 6, the external device 600 may include a sensor 610, a selector 620, an updater 650, a storage unit 630, and a communication unit 640.

The sensor 610 may sense environment information. For example, the sensor 610 may include a timer to sense time information, a GPS sensor to sense location information, or an accelerometer to sense moving speed information. In another example, the sensor 610 may generate speed information by combining the location information obtained by the GPS sensor and the time information obtained by the timer, instead of including the speed sensor.

The storage unit 630 may store sound environment category sets based on a life pattern. For example, the storage unit 630 may store the sound environment category sets, such as, for example, 360, 370, and 380 of FIG. 3, based on the life pattern 300 of FIG. 3. Each of the sound environment category sets, 360, 370, and 380, may include sound environment categories, for example, a speech category, a music category, a noise category, and a noise plus speech category. Referring to FIG. 2, individual sound environment categories, for example, 210, 220, 230, and 240, may correspond to sound feature maps, for example, 215 and 245.

The selector 620 may select one of the pattern elements of the life pattern based on environment information. For example, the selector 620 may select one of the pattern elements, for example, 310, 320, 330, 340, and 350 of the life pattern 300 of FIG. 3. The selection may be based on time included in the environment information.

The communication unit 640 may transmit, to the hearing device 100, a sound environment category set corresponding to the selected pattern element. For example, when the pattern element 340 of the life pattern 300 is selected, the communication unit 640 may transmit, to the hearing device 100, the sound environment category set 370 corresponding to the pattern element 340. The communication unit 640 may transmit, to the hearing device 100, a sound feature map corresponding to the speech category, a sound feature map corresponding to the music category, a sound feature map corresponding to the noise category, and a sound feature map corresponding to the noise plus speech category. The communication unit 640 may use various wireless communication methods, such as, for example, Bluetooth, near-field communication (NFC), infrared communication, and wireless fidelity (WiFi). Also, a wired communication method may be applied by the communication unit 640.

The hearing device 100 of FIG. 6 may include a communication unit 150. The communication unit 150 may receive a sound environment category set that is transmitted from the external device 600. The communication unit 150 may use any of the wired or wireless methods applied to the communication unit 640 of the external device 600. The received sound environment category set may be provided to a classifier 120. The classifier 120 may classify sound information input to an input unit 110 as a category, using the received sound environment category set. The classifier 120 may extract a sound feature from the input sound information. The classifier 120 may classify the sound information by substituting the extracted sound feature to the sound feature maps corresponding to categories of the sound environment category set. The classifier 120 may detect a sound feature map outputting a highest value as a result of the substituting, and select a sound environment category corresponding to the detected sound feature map. The classifier 120 may classify the sound information into the selected sound environment category. The controller 130 may control an output of the sound information based on the classified sound environment category.

The communication unit 150 may transmit, to the external device 600, the sound features extracted from the sound information to update the sound environment category set. The communication unit 640 of the external device 600 may receive the sound features transmitted from the hearing device 100 and provide the received sound features to an updater 650. The updater 650 may update the sound environment category sets stored in the storage unit 630, based on the received sound features. For example, the updater 650 may update a sound environment category set corresponding to a pattern element selected by the selector 620. The updater 650 may update a sound feature map corresponding to a category of sound environment in a corresponding sound environment category set. The category of sound environment was previously classified by the classifier 120 of the hearing device 100. The communication unit 150 of the hearing device 100 may transmit, to the external device 600, information of the category classified by the classifier 120.

Figure 7:
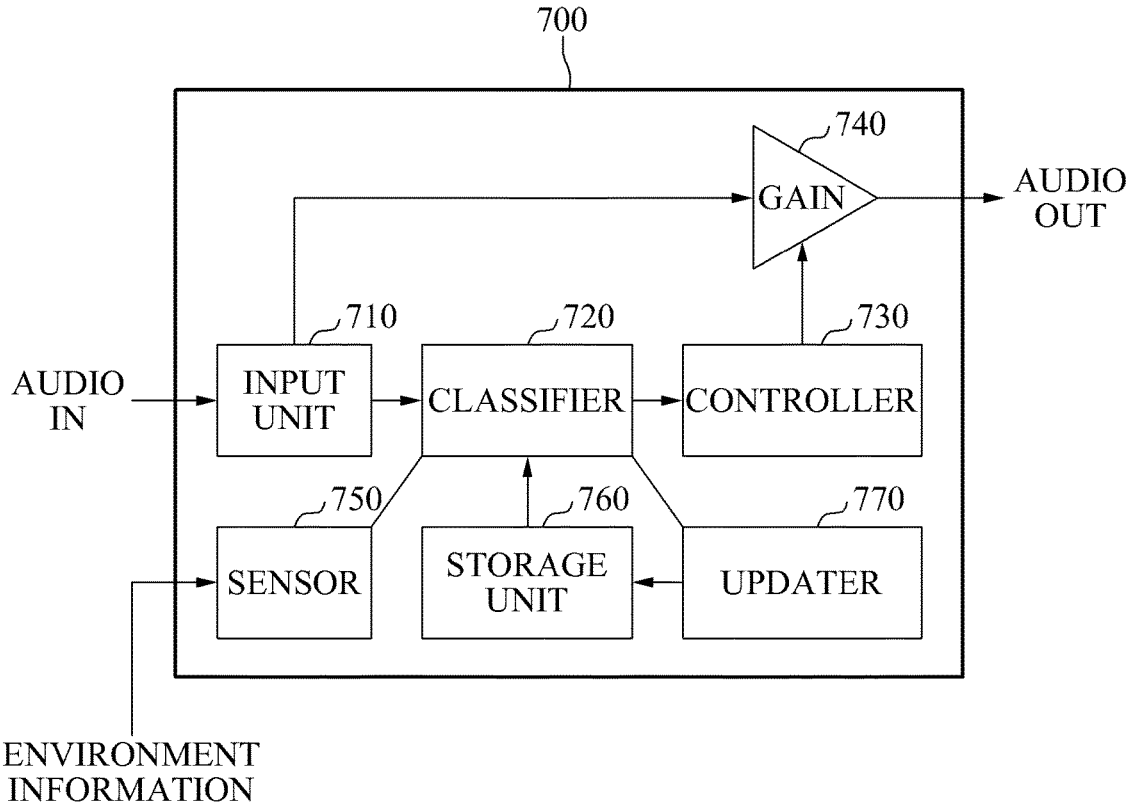
FIG. 7 is a diagram illustrating another example of a hearing device.

FIG. 7 is a diagram illustrating another example of a hearing device 700. Referring to FIG. 7, the hearing device 700 may include an input unit 710, a classifier 720, and a controller 730. The hearing device 700 may further include an output gain adjuster 740. Descriptions provided in FIGS. 1 through 6 may be applicable to the input unit 710, the classifier 720, the controller 730, and the output gain adjuster 740 and is incorporated herein by reference. Thus, the above description may not be repeated here.

Unlike the hearing device 600 of FIG. 6, the hearing device 700 may further include a sensor 750, a storage unit 760 and an updater 770. Descriptions provided in FIGS. 1 through 6 may be applicable to the sensor 750, the storage unit 760, and the updater 770 and is incorporated herein by reference. Thus, the above description may not be repeated here.

Figure 8:
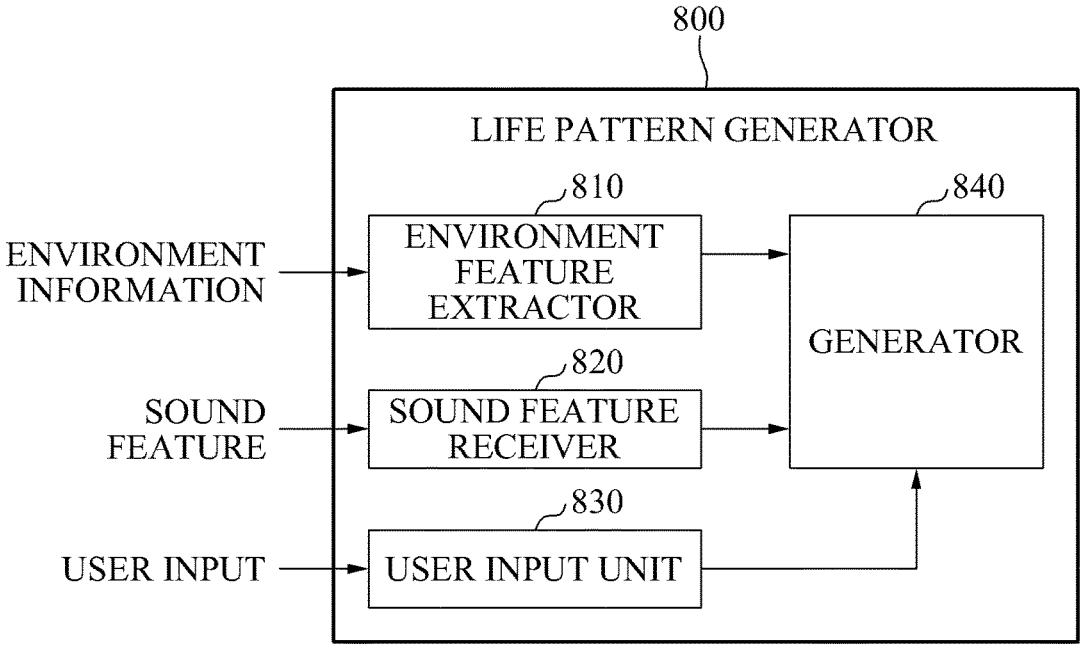
FIG. 8 is a diagram illustrating an example of a life pattern generator.

FIG. 8 is a diagram illustrating an example of a life pattern generator 800. Referring to FIG. 8, the life pattern generator 800 may generate a life pattern. For example, the life pattern generator 800 may generate the life pattern 300 of FIG. 3, the life pattern 400 of FIG. 4, or the life pattern 500 of FIG. 5. The life pattern generator 800 may be provided in a hearing device or it may be an external device interworking with the hearing device.

The life pattern generator 800 may include a user input unit 830. The user input unit 830 may receive an input from a user. The user may input a life pattern through the user input unit 830. A generator 840 may generate the life pattern based on the user input received from the user input unit 830. For example, the generator 840 may generate the life pattern 300 of FIG. 3, the life pattern 400 of FIG. 4, or the life pattern 500 of FIG. 5, using a schedule input by the user. The generator 840 may generate pattern elements included in the life pattern.

The life pattern generator 800 may further include an environment feature extractor 810. The environment feature extractor 810 may extract an environment feature from environment information. The extracted environment feature may be used as a standard for distinguishing the pattern elements in the life pattern from one another. The generator 840 may generate a life pattern based on the environment feature extracted by the environment feature extractor 810. For example, the generator 840 may generate the life pattern 300 of FIG. 3, the life pattern 400 of FIG. 4, or the life pattern 500 of FIG. 5, without the user input. The generator 840 may generate the pattern elements included in the life pattern.

The life pattern generator 800 may further include a sound feature receiver 820. The sound feature receiver 820 may receive a sound feature extracted by the classifier 120 of FIG. 1. The generator 840 may generate sound environment category sets corresponding to various sound environments, based on the sound feature. The generator 840 may generate a sound environment category set corresponding to a sound environment. The generator 840 may generate sound environment categories included in the generated sound environment category set. The generator 840 may generate sound feature maps corresponding to the generated sound environment categories. The generator 840 may perform matching on the sound environment category sets suitable for each of the pattern elements included in the life pattern.

Figure 9:
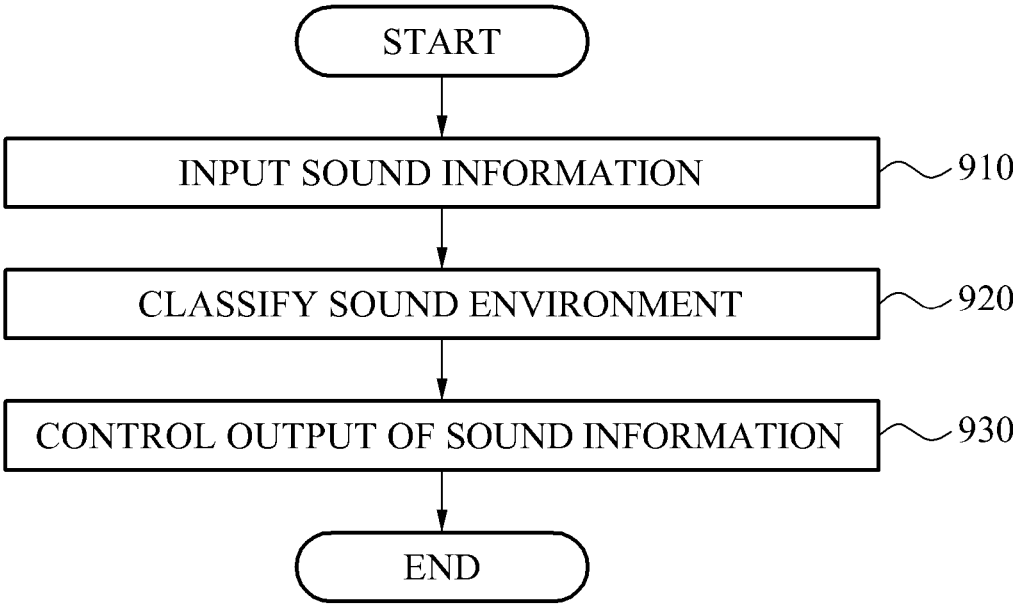
FIG. 9 is a drawing illustrating an example of a method of controlling a hearing device.

FIG. 9 is a diagram illustrating an example of a method of controlling a hearing device. Referring to FIG. 9, the method of controlling the hearing device may include receiving an input of sound information in 910, classifying sound environment in 920, and controlling an output of the sound information in 930. The operations in FIG. 9 may be performed in the sequence and manner as shown, although the order of some operations may be changed or some of the operations omitted without departing from the spirit and scope of the illustrative examples described. Many of the operations shown in FIG. 9 may be performed in parallel or concurrently.

Operations of the input unit 110 of FIG. 1 may be applicable to the receiving of the sound information in 910, operations of the classifier 120 of FIG. 1 may be applicable to the classifying of the sound environment in 920, and operations of the controller 130 of FIG. 1 may be applicable to the controlling of the output in 930. Descriptions provided in FIGS. 1 through 8 is also applicable to FIG. 9, and is incorporated herein by reference. Thus, the above description may not be repeated here.

As a non-exhaustive illustration only, a terminal or device described herein may refer to mobile devices such as a cellular phone, a personal digital assistant (PDA), a digital camera, a portable game console, and an MP3 player, a portable/personal multimedia player (PMP), a handheld e-book, a portable laptop PC, a global positioning system (GPS) navigation, a tablet, a sensor, and devices such as a desktop PC, a high definition television (HDTV), an optical disc player, a setup box, a home appliance, and the like that are capable of wireless communication or network communication consistent with that which is disclosed herein.

The processes, functions, and methods described above can be written as a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device that is capable of providing instructions or data to or being interpreted by the processing device. The software also may be distributed over network coupled computer systems so that the software is stored and executed in a distributed fashion. In particular, the software and data may be stored by one or more non-transitory computer readable recording mediums. The non-transitory computer readable recording medium may include any data storage device that can store data that can be thereafter read by a computer system or processing device. Examples of the non-transitory computer readable recording medium include read-only memory (ROM), random-access memory (RAM), Compact Disc Read-only Memory (CD-ROMs), magnetic tapes, USBs, floppy disks, hard disks, optical recording media (e.g., CD-ROMs, or DVDs), and PC interfaces (e.g., PCI, PCI-express, WiFi, etc.). In addition, functional programs, codes, and code segments for accomplishing the example disclosed herein can be construed by programmers skilled in the art based on the flow diagrams and block diagrams of the figures and their corresponding descriptions as provided herein.

The apparatuses and units described herein may be implemented using hardware components. The hardware components may include, for example, controllers, sensors, processors, generators, drivers, and other equivalent electronic components. The hardware components may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The hardware components may run an operating system (OS) and one or more software applications that run on the OS. The hardware components also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a hardware component may include multiple processors or a processor and a controller. In addition, different processing configurations are possible, such a parallel processors.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A hearing device, comprising:

an input unit configured to receive sound information;

a classifier configured to:

select, from among a plurality of sound environment category sets, a sound environment category set based on a life pattern, extract a sound feature from the sound information, compare, based on the sound feature, sound feature maps corresponding to sound environment categories included in the selected sound environment category set, classify the sound information into a category based on the comparison, compare a first height of a first contour line obtained, based on the sound feature, from a first sound feature map of the sound feature maps, to a second height of a second contour line obtained, based on the sound feature, from a second sound feature map of the sound feature maps, select, from the sound feature maps, a sound feature map outputting a height greater than at least one of the first height or the second height, and select a sound environment category, of the sound environment categories, corresponding to the selected sound feature map; and a controller configured to control an output of the sound information, based on the classified category.

2. The device of claim 1, wherein the sound environment category set corresponds to a pattern element of the life pattern, based on environment information.

3. The device of claim 1, wherein:

the controller is further configured to control the output of the sound information, by using a setting corresponding to the classified category.

4. The device of claim 1, wherein the controller is further configured to adjust output gain of frequency components in the sound information, based on the classified category.

5. The device of claim 1, wherein the life pattern comprises pattern elements corresponding to different sound environment category sets.

6. The device of claim 1, further comprising:

a communicator configured to receive the sound environment category set from a device connected to the hearing device.

7. The device of claim 6, wherein the sound environment category set is selected based on environment information sensed by the device, and comprises sound environment categories corresponding to sound feature maps.

8. The device of claim 6, wherein the communicator is further configured to transmit, to the device: a sound feature extracted from the sound information, to update the sound environment category set.

9. The device of claim 2, wherein the environment information comprises at least one of: time information, location information, or speed information.

10. A device interworking with a hearing device, the device comprising:

a store configured to store sound environment category sets, based on a life pattern, the sound environment category set comprising sound environment categories corresponding to sound feature maps;

a sensor configured to sense environment information;

a selector configured to select a pattern element, based on the environment information; and a communicator configured to transmit, to the hearing device, a sound environment category set corresponding to the selected pattern element, wherein a sound feature map of the sound feature maps is generated in response to determining a Mel-Frequency Cepstrum Coefficient (MFCC) distribution and a spectral roll-off distribution of an input and a sound environment, and wherein the MFCC distribution is indicated by a first axis of the sound feature map, and the spectral roll-off distribution is indicated by a second axis of the sound feature map.

11. The device of claim 10, wherein the life pattern comprises the pattern elements corresponding to different sound environment category sets.

12. The device of claim 10, further comprising:

an updater configured to update the sound environment category set, based on a sound feature received from the hearing device; and wherein the sound feature is extracted from sound information by the hearing device.

13. The device of claim 10, wherein the sensor is configured to sense at least one of: time information, location information, or speed information.

* * * * *